United States Patent [19]

Wallenius

[11] 4,216,739

[45] Aug. 12, 1980

[54] PAINTING MACHINE

[75] Inventor: Jan F. Wallenius, Täby, Sweden

[73] Assignee: Ventive AB, Täby, Sweden

[21] Appl. No.: 854,786

[22] Filed: Nov. 25, 1977

[30] Foreign Application Priority Data

Nov. 26, 1976 [SE] Sweden ..... 7613256

[51] Int. Cl.[2] ..... B05C 1/08

[52] U.S. Cl. ..... 118/216; 118/249; 118/262

[58] Field of Search ..... 118/249, 250, 262, 216; 101/351, 352, 185

[56] References Cited

U.S. PATENT DOCUMENTS

| | | | |
|---|---|---|---|
| 2,293,691 | 8/1942 | Harrigan | 118/262 X |
| 3,659,554 | 5/1972 | Friz et al. | 118/DIG. 4 |
| 3,738,265 | 6/1973 | Saueressig | 101/351 X |
| 3,792,658 | 2/1974 | Shore et al. | 101/352 X |

FOREIGN PATENT DOCUMENTS

| | | | |
|---|---|---|---|
| 505679 | 1/1953 | Belgium | 101/351 |
| 927198 | 5/1963 | United Kingdom . | |

OTHER PUBLICATIONS

Kreisler, R., "Von der Walze Hangt es Ab," MN-Industrie-Journal, 1972, pp. 216-218.

*Primary Examiner*—John P. McIntosh
*Attorney, Agent, or Firm*—Berman, Aisenberg & Platt

[57] ABSTRACT

A machine for painting sheet strip material has a backing roll for the sheet strip material, two paint coating devices, and means for positioning the paint coating devices alternatingly in an operative position and a non-operative position in relation to the sheet strip material passing over the backing roll.

16 Claims, 13 Drawing Figures

PAINTING MACHINE

This invention relates to painting machines.

More particularly, the invention relates to a machine for painting metal or other sheet strip material having a backing roll for the strip material and a paint coating device comprising a paint tub and rolls for supplying paint from the paint tub to the sheet strip material running over the backing roll.

It is a primary object of this invention to provide a new and improved painting machine of the type referred to above wherein it is possible to adjust the rolls of the paint coating device when the painting machine is being operated.

It is a further object of this invention to provide a new and improved painting machine of the kind referred to wherein an accurate control of the thickness of the paint coating can be made.

A still further object of this invention is to provide a new and improved painting machine of the kind referred to wherein the maintenance work is facilitated.

Additional objects and advantages of the invention in part will be set forth in the description which follows and in part will be obvious from the description, or may be learned by practice of the invention. The objects and advantages of the invention may be realized and attained by means of the instrumentalities and combinations partially pointed out in the appended claims.

To achieve the foregoing objects and in accordance with the purpose of the invention, as embodied and broadly described herein, the machine for painting sheet strip material of this invention comprises a backing roll for the sheet strip material, two paint coating devices each comprising a paint tub and rolls for coating the sheet strip material running over the backing roll, with paint from the paint tub, and means pivotally mounting said paint coating devices for positioning the paint coating devices alternatingly in an operative position in which the related paint coating device co-operates with the backing roll, and a non-operative position in which the related paint coating device is displaced from the path of the sheet strip material extending through the painting machine.

The accompanying drawings which are incorporated in and constitute a part of this specification illustrate embodiments of the invention and, together with the description, serve to explain the principles of the invention.

Reference will now be made in detail to the present preferred embodiments of the invention, examples of which are illustrated in the accompanying drawings.

Figure 1:
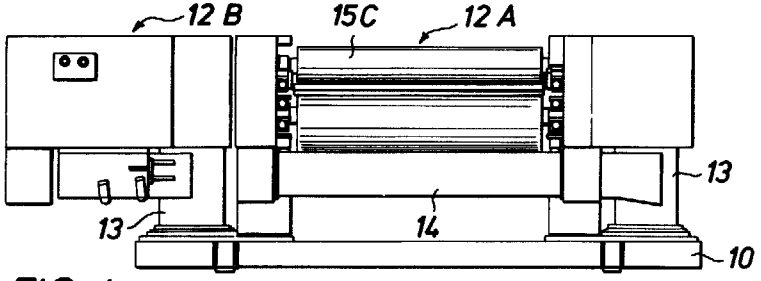
FIG. 1 is a front view of a first embodiment of a painting machine according to the teachings of the invention.
Figure 2:
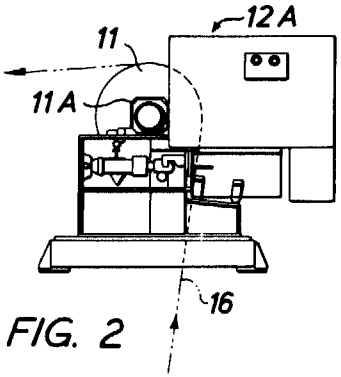
FIG. 2 is a side view of the painting machine at right angle to that in FIG. 1.
Figure 3:
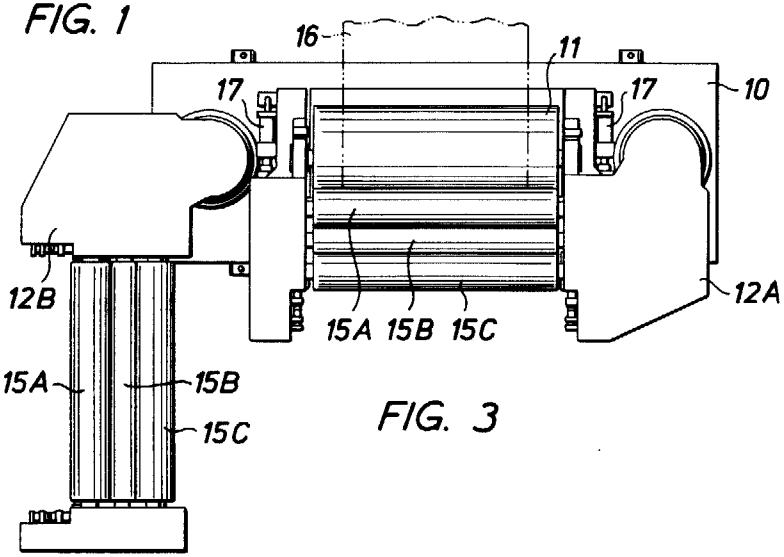
FIG. 3 is a plan view of the painting machine of FIGS. 1 and 2.

Referring to FIGS. 1 to 3 of the drawings, the painting machine disclosed therein comprises a machine frame 10 in which there is rotatably mounted a backing roll 11 in bearings 11A. In the frame 10 there are also mounted two paint coating devices 12A and 12B by means of standards 13 for swinging movement about vertical axes. Each paint coating device comprises a paint tub 14 and paint coating rolls 15A, 15B, and 15C, the roll 15A being an applicator roll, roll 15B being a pick-up roll, and roll 15C being a distribution roll. The roll 15A comprises a rubber-coated roll while the roll 15B is a hardchromium-plated roll. Roll 15C can be either a rubber-coated roll or a hardchromium-plated roll.

Each paint coating device can be swung between the position disclosed in FIGS. 1 to 3 with relation to the paint coating device 12A, which is the operative position, and the position shown with relation to the paint coating device 12B, which is the non-operative position. In the operative position of each paint coating device the pick-up roll 15B carries paint from the paint tub 14 to the applicator roll 15A which deposits the paint on a metal or other sheet strip material 16 passing over the backing roll 11. The distribution roll 15C distributes the paint over the pick-up roll; this roll can be dispensed with if desired. The paint coating device operates in the conventional manner in the operative position for painting the passing sheet strip material at one side thereof.

When the paint coating device 12A is operative, maintenance work can be performed on the other paint coating device 12B notwithstanding the production is going on in the machine, and vice versa. The maintenance work can include washing and drying of the paint coating rolls or grinding of the rubber roll or rolls, which has to be done from time to time. It is necessary to interrupt the painting for the short period only, which is necessary for swinging one paint coating device from the operative position and the other paint coating device to the operative position, and this can be done manually or by means of pneumatic, hydraulic or electric motor drive means provided in the standards 13 or connected externally to said standards. E.g. a hydraulic cylinder may be connected between the machine frame 10 and a lug or an arm projecting from the standard. In the same simple manner change of colour can be made, one paint coating device being used for paint of one colour and the other one for paint of another colour.

Figure 4:
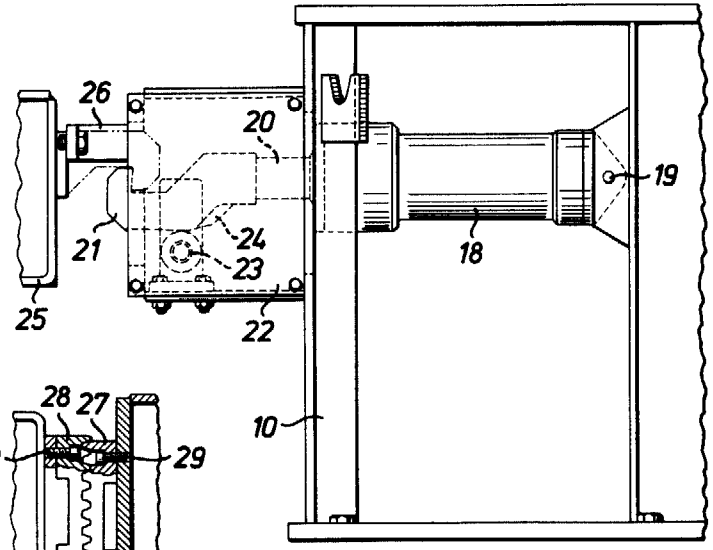
FIG. 4 is a side view of a device for locking the paint coating device in the operative position.
Figure 5:
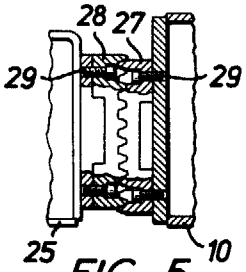
FIG. 5 is a side view, partly a vertical sectional view, of guide means on the paint coating device and the machine frame for exactly locating the paint coating device in the operative position.

Means 17 are provided for retaining the paint coating device in the operative position with the applicator roll 15A in the intended position in relation to the metal or other sheet strip material 16 passing over the backing roll 11. With reference to FIGS. 4 and 5 of the drawings such means comprise a hydraulic cylinder 18 which is pivotally mounted to the machine frame 10 at 19 for swinging movement about a horizontal axis, and the piston rod 20 of which is provided with an upwardly projecting hook 21. This hook is supported in an enlargement 22 of the frame 10 by means of a support pulley rotatably mounted therein, and on the lower side of the hook there is arranged a pulley track 24 of such a form that the hydraulic cylinder in the position shown wherein the hook is maintained in a withdrawn position is substantially horizontal while the hydraulic cylinder is swung downwardly to lower the hook when the hook is protruded (to the left) by means of the hydraulic cylinder. On the frame of the paint coating device, fragmentarily indicated at 25, there is fixedly mounted a downwardly projecting hook 26 of a form corresponding to that of the hook 21. By protruding the hook 21, this hook at the same time being lowered, it is possible to move the hook 26 over the hook 21 when the related paint coating device is swung to the operative position, and then, when the hook 21 is withdrawn, it is raised to engage the hook 26 guided by the support pulley 23, and thus the paint coating device is drawn against the frame 10. On the paint coating device or the frame there can be provided a cushioning which stops the swinging movement of the paint coating device in the position in which the hooks can engage each other for drawing the paint coating device over the end part of the movement towards the operative position.

For an accurate localisation of the paint coating device in relation to the machine frame 10 in the operative position there are provided on the machine frame and on the frame 25 of the paint coating device two toothed segments 27 and 28 which are arranged in a vertical position and are fixedly connected with the machine frame and the frame of the paint coating device, respectively, by means of screws 29. These toothed segments provide an exact localisation of the paint coating device in the vertical direction by forming engaging and guiding abutments between the paint coating device and the machine frame.

Figure 7:
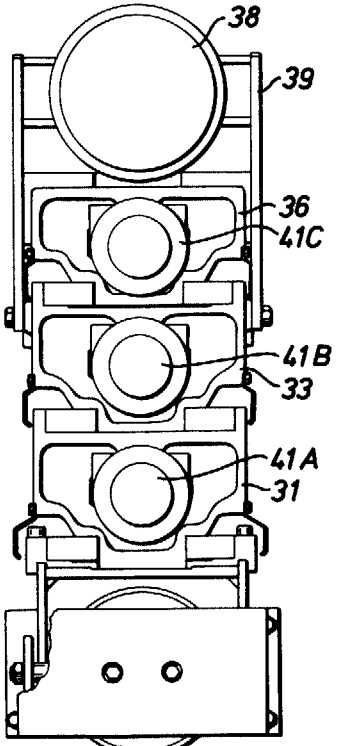
FIG. 7 is an end view of the bracket unit.
Figure 6:
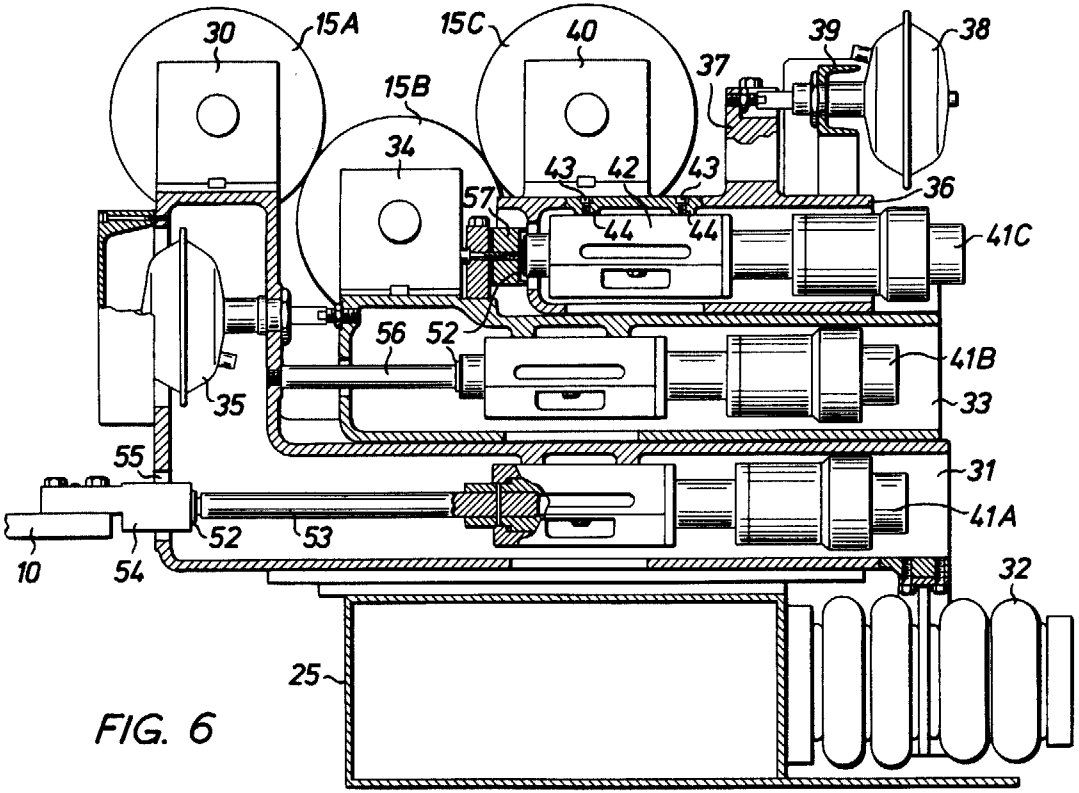
FIG. 6 is a vertical sectional view of bearing brackets for the paint coating rolls of the paint coating device.

It is essential that the three rolls 15A, 15B, and 15C of the paint coating device can be adjusted in relation to each other and in relation to the sheet strip material 16 passing over the backing roll 11 so that there is obtained at each time during the painting the intended thickness of the paint coating on the sheet strip material and this thickness is the same over the entire width of the strip material and so that the positions of the rolls can be adjusted when a roll has been ground. FIGS. 6 and 7 show how the rolls are rotatably mounted in order to make it possible to accurately adjust the positions of the rolls, the rolls being moved to the non-operative position and also being separated from each other for maintenance work in the non-operative position without the adjustment previously made being changed when the rolls are returned to the operative position.

The bearings 30 of the applicator roll 15A at each end of the roll are supported by an angular hollow bracket 31 which in turn is supported by the frame 25 of the paint coating device so that it is guided for longitudinal displacement on the frame. The bracket can be guided by means of guiding vees or the like. The bracket is connected with a double-acting bellows type cylinder 32 which is fixedly mounted to the frame 25, and the bracket can be reciprocated on the frame over a limited distance by means of said bellows type cylinder. A bracket 33 which supports the bearings 34 of the pick-up roll 15B is also hollow and is displaceably guided on top of the bracket 31 on the horizontal portion thereof and is connected with a compressed-air diaphragm 35 which is mounted on the vertical portion of the bracket 31 and provides a limited displacement of the bracket 33 in relation to the bracket 31. Finally, there is displaceably guided on top of the bracket 33 a bracket 36, also hollow, which is connected at a projecting flange 37 to a compressed-air diaphragm 38 which is mounted on a yoke 39 connected with the bracket 33. By means of this compressed-air diaphragm the bracket 36 can be displaced in relation to the bracket 33. The bracket 36 supports the bearings 40 of the distribution roll 15C.

The bellows type cylinder 32 and the compressed-air diaphragms 35 and 38 are provided for rapid displacement of the rolls so that they can rapidly be separated from each other for maintenance work. However, for an accurate adjustment of the rolls in relation to each other and in relation to the sheet strip material 16 running over the backing roll 11 there are provided other means, viz. adjusting means 41A, 41B, and 41C for each of the rolls 15A, 15B and 15C, mounted inside the associated brackets 31, 33, and 36.

Figure 8:
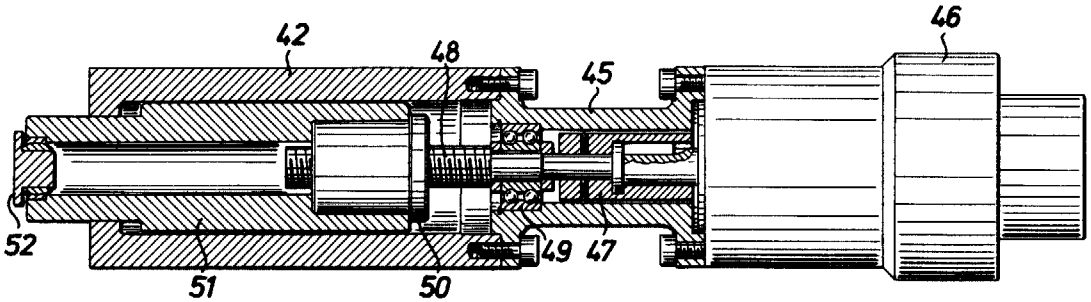
FIG. 8 is an axial sectional view, partly a side view, of a motor-driven adjusting screw of a bearing bracket.

According to FIG. 8, each adjusting means comprises a guide socket 42 which is screwed to the associated bracket in the interior thereof as is shown with regard to the bracket 36 wherein the socket 42 of the adjusting means 41C is connected by screws 43 at interior lugs 44 in the bracket. By means of a transition portion 45 a pneumatic motor 46 of the rotating type is connected to the socket 42 and the rotatable output member 47 of this motor is connected to a screw spindle 48 rotatably mounted by ball bearings 49 in the transition portion 45 and threadingly engaging a nut 40 which is non-rotatably and axially non-displaceably connected to a piston 51 which is displaceably guided in the guide socket 42. The piston is tubular and at the outer end thereof projecting from the guide socket there is universally mounted an abutment plate 52.

By the rotation of the screw spindle in one direction or the other by means of the pneumatic motor 46 the piston thus can be reciprocated in the guide socket 42 in order to project the abutment plate more or less from the guide socket.

Referring again to FIG. 6, it is shown therein that the piston of the adjusting means 41A is prolonged by a rod 53 and that the abutment plate 52 is mounted at the outer end of this rod in the same manner as is shown in FIG. 8. On the machine frame 10 there is mounted an abutment 54 which can be introduced in the interior of the bracket 31 through an opening 55, and the adjusting means 41A can be applied against this abutment at the plate 52 thereof. When the paint coating device is swung to and from the operative position the bracket 31 is in a withdrawn position to the right in FIG. 8, which has been attained by means of the bellows type cylinder 32 in order that the abutment 54 shall be located outside the bracket and shall not interfere with the swinging movement of the paint coating device. However, when the paint coating device has arrived at the operative position, the bracket 31 and thus the entire bracket unit is moved towards the machine frame to the left in FIG. 8 by means of the bellows type cylinder 32 so that the plate 52 will engage the abutment 54. Then, the adjusted position of the adjusting means 41A defines the position of the bracket 31 and thus of the applicator roll 15A, and it will be realized that it is thus possible to define by means of the adjusting means 41A the position of the applicator roll in relation to the sheet strip material running over the backing roll when the paint coating device is in the operative position.

The adjusting means 41B is provided for adjusting the pick-up roll 15B in relation to the applicator roll 15A, and for this purpose there is provided on the bracket 31 an abutment rod 56 against which the plate 52 of the adjusting means 41B is intended to bear, and in the same manner the position of the distribution roll 15C in relation to the pick-up roll is determined by the adjusting means 41C, the plate 52 of which is intended to co-operate with an abutment 57 on the bracket 33.

Thus, it will be seen that the positions of the brackets 31, 33, and 36 and the positions of the associated rolls can be accurately controlled by the associated adjusting means. The position of the bracket 31 can be changed either by positioning the adjustment means 41A or by displacing the bracket by means of the bellows type cylinder 32 or by swinging the entire paint coating device on the standard 13 without changing the positions of the rolls included in the paint coating device in relation to each other.

There is a bracket unit at each of the two ends of the rolls and associated adjusting means and thus it is possible to accurately control by these adjusting means the relative positions of the rolls and the position of the applicator roll in relation to the sheet strip material passing over the backing roll 11 with regard to the distance as well as the parallelity.

Figure 9:
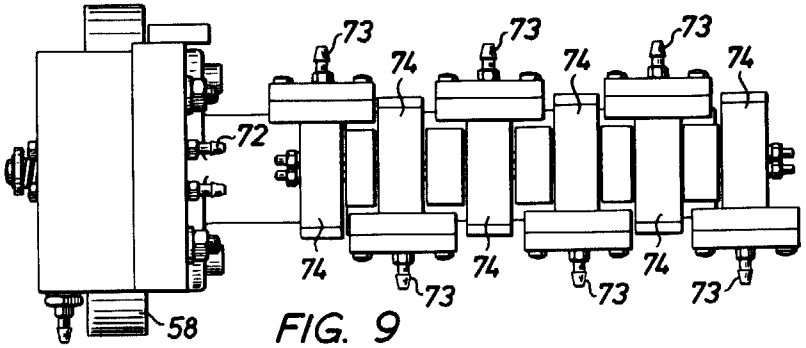
FIG. 9 is a side view of a valve unit including a pulse generator for controlling the adjusting screws of the bearing brackets.
Figure 10:
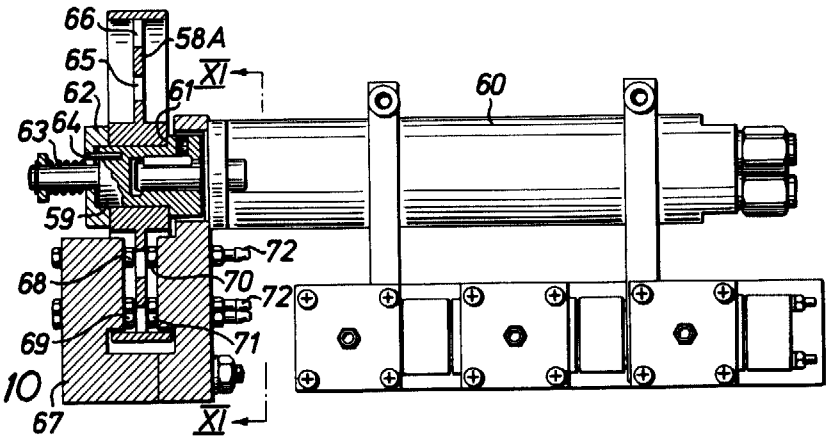
FIG. 10 is a plan view, partly a horizontal sectional view, of the unit shown in FIG. 9.
Figure 11:
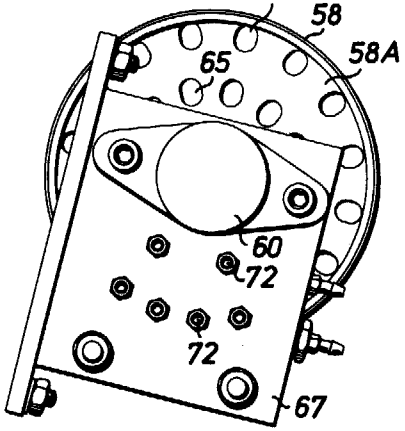
FIG. 11 is a view of the pulse generator along line XI—XI in FIG. 10.

According to the invention, the adjusting motors 46 are preferably of the stepping type operating in dependence of supplied pressure pulses, and in that case the control of the stepping motors can be arranged as is shown in FIGS. 9 to 11. A manually rotatable wheel 58, a so-called thumb wheel, is rotatably mounted on the rotatable stub shaft 59 of a compressed-air motor 60 of the rotating type. The thumb wheel 58 is kept pressed against a shoulder 61 on the stub shaft 59 by means of a washer 62 which is biassed by a compression spring 63 on the stub shaft. The washer 62 is non-rotatably connected with the stub shaft 59 by means of a pin 64 to rotate together with the stub shaft and forms together with the spring a slip coupling between the stub shaft and the thumb wheel allowing the thumb wheel to be rotated in relation to the stub shaft against a predetermined frictional resistance.

In the disc 58A of the thumb wheel there are provided two circular rows of openings, an inner one 65 and an outer one 66, and in the path of rotation of these openings there is provided a pulse transmitter 67. This comprises nozzles 68 and 69 for supplying air jets in the circular path of movement of the openings 65 and 66, respectively, transversely of the disc 58A of the thumb wheel, and opposite to these nozzles but on the other side of the disc there are provided air sensors 70 and 71 the number of which corresponds to the number of nozzles. At nipples 72 these sensors are connected to nipples 73 on valves 74 the number of which corresponds to the number of sensors, by conduits, not shown. These valves are so-called amplifier valves and compressed air is supplied to them in order that the amplifier valves shall supply compressed-air pulses in dependence of compressed-air pulses supplied by the pulse transmitter, from one connection or the other of two connections on each valve, to the associated adjusting motor. By means of the compressed-air pulses supplied to the adjusting motor 46 said motor is operated stepwise in one direction or the other depending on the direction in which the thumb wheel has been rotated.

The two first valves 74 in the present case are assumed to be connected to the adjusting motor 46 in the bracket 31 at one end and the other, respectively, of the applicator roll 15A, and these valves are controlled in dependence of the openings 65 in the thumb wheel, i.e. the inner circle of openings, while the four other valves are connected in pairs to the adjusting motor 46 in the bracket 33 at one end and the other of the pick-up roll 15B and are controlled in dependence of the openings 66 in the thumb wheel, i.e. the outer circle of openings.

The two circles of openings 65 and 66 are adjusted in relation to each other in such a way as regards the size and the pitch of the openings with due consideration of the geometry of the rolls 15A and 15B that the pick-up roll 15B follows the movement of the applicator roll 15A when said latter roll is adjusted in relation to the sheet strip material 16 running over the backing roll 11. Then, the pick-up roll is adjusted in relation to the applicator roll to the position which corresponds to the adjusted position of the applicator roll in relation to the strip material. It is thus possible to attain automatically the correct adjustment of the applicator roll and the pick-up roll when the applicator roll has been ground, by adjusting the applicator roll in relation to the strip material.

However, the position of the paint coating rolls can also be adjusted by pulsing the adjusting motors provided for the respective rolls individually by means of manually controlled valves. Either both adjusting motors at the respective ends can be operated simultaneously for parallel displacement of the roll, or only one of the two adjusting motors of a roll can be operated in order to adjust the parallelity.

It is also possible to connect the adjusting motors to valves which are controlled in dependence of a sensor measuring the thickness of the paint coating so that this thickness at all times is kept at a predetermined value.

Figure 12:
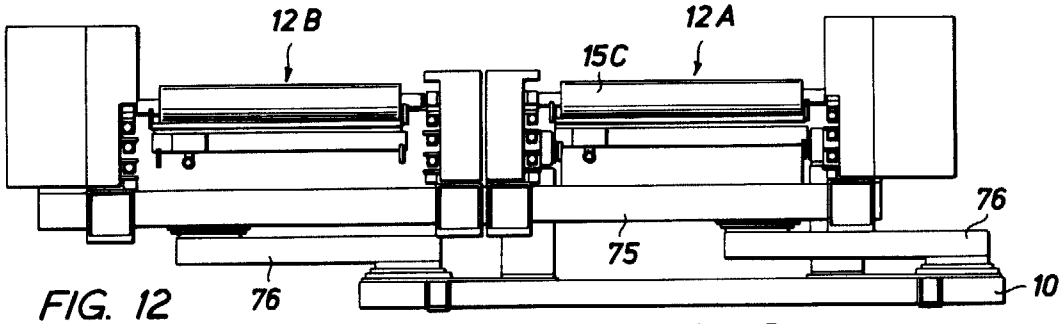
FIG. 12 is a view as that in FIG. 1 of a second embodiment of the painting machine according to the teachings of the invention.
Figure 13:
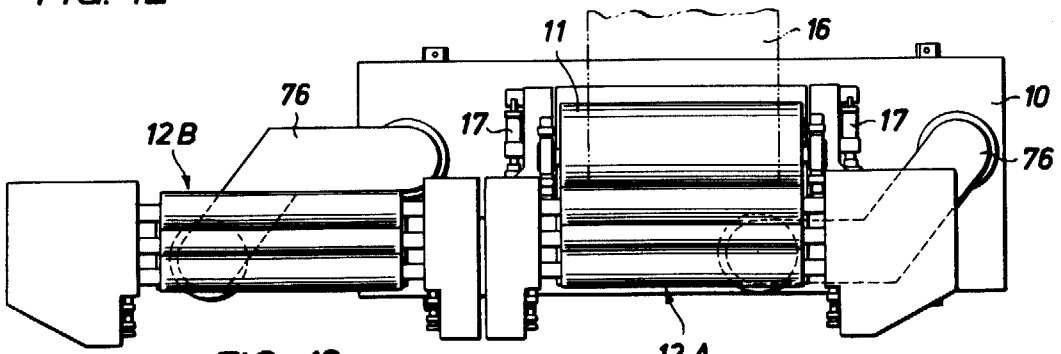
FIG. 13 is a plan view of the painting machine shown in FIG. 11.

In the embodiment according to FIGS. 12 and 13 the two paint coating devices 12A and 12B are arranged beside each other on a common support beam 75. This beam is supported by two links 76 which are pivotally mounted to the support beam and to the frame 10 for swinging movement about vertical axes. The links 76 form together with the beam 75 and the frame 10 a parallelogram type guide mechanism by means of which the two paint coating devices can be displaced along a curve, the links being swung clockwise as seen in FIG. 13 from the position shown therein, in which the paint coating device 12A is in the operative position and the paint coating device 12B is in the non-operative position, to another position in which the paint coating device 12B is in the operative position while the paint coating device 12A is in the non-operative position to the right of the backing roll 11. By moving the paint coating devices along a curve in this way the paint coating devices are displaced from the backing roll 11, and are moved in the axial direction thereof, and are finally displaced towards the backing roll 11.

It will be apparent to those skilled in the art that various other modifications and variations in addition to those mentioned above could be made in the painting machine of the invention without departing from the scope and spirit of the invention.

I claim:

1. A machine for painting sheet strip material comprising (a) a backing roll for the sheet strip material, (b)

two paint-coating devices arranged beside each other on a common supporting member which extends in parallel to the backing roll, and further comprising a parallelogram-type guiding mechanism by means of which the supporting member is displaceable towards and away from the backing roll as well as along the backing roll, each of the coating devices comprising a paint tub and rolls for coating the sheet strip material, running over the backing roll, with paint from the paint tub and (c) means pivotally mounting said paint-coating devices for positioning each alternatingly in an operative position in which it co-operates with the backing roll and a non-operative position in which it is displaced from the path of the sheet-strip material.

2. A machine as claimed in claim 1 which has a frame and further comprises, for each paint-coating device:

(i) a first bracket supporting one of said rolls, the first bracket being mounted in the paint-coating device for displacement transversely of the rolls;

(ii) a second bracket supporting another of said rolls, the second bracket being mounted to said first bracket for displacement transversely of the rolls;

(iii) means for displacing said first bracket and the roll supported thereby towards and away from the backing roll;

(iv) means for displacing said second bracket and the roll supported thereby towards and away from said one roll;

(v) co-operating first abutment members on said first bracket and on the frame of the machine, respectively, for limiting displacement of said one roll towards said backing roll;

(vi) co-operating second abutment members on said first bracket and on said second bracket, respectively, for limiting displacement of said other roll towards said one roll, each of one of the first co-operating abutment members and one of said second co-operating abutment members being operatively connected with a screw spindle; and (vii) each screw spindle being rotatable means to displace the abutment operatively connected therewith.

3. A machine as claimed in claim 2 further comprising means for locking each paint-coating device in the operative position.

4. A machine for painting sheet-strip material comprising (a) a frame of the machine, (b) a backing roll for the sheet-strip material, (c) two paint-coating devices, each comprising a paint tub and rolls for coating the sheet-strip material, running over the backing roll, with paint from the paint tub, (d) means pivotally mounting said paint-coating devices for positioning each alternatingly in an operative position in which it co-operates with the backing roll and a non-operative position in which it is displaced from the path of the sheet strip material and (e) means for locking each paint-coating device in the operative position, which means comprise a hook on the paint-coating device and a hook mounted in the frame of the machine, said latter hook being displaceable horizontally as well as vertically in order to be displaced vertically into engagement with the hook on the paint-coating device when being displaced horizontally for moving the paint-coating device towards the backing roll.

5. A machine as claimed in claim 4 wherein each paint coating device comprises an applicator roll and a pick-up roll co-operating therewith; a first bracket supporting the applicator roll, said first bracket being mounted in the paint coating device for displacement transversely of the applicator roll; and a second bracket supporting the pick-up roll, said second bracket being mounted to said first bracket to be displaceable in the transverse direction of the pick-up roll and the applicator roll.

6. A machine as claimed in claim 5 further comprising means for displacing said brackets.

7. A machine as claimed in claim 5 further comprising an adjustable abutment member on each bracket, a stationary abutment on the frame of the machine for co-operation with the abutment member of said first bracket, and an abutment on said first bracket for co-operation with the abutment member on said second bracket.

8. A machine as claimed in claim 7 wherein each of the adjustable abutment members comprises a screw spindle, an abutment on said screw spindle, and a drive motor operatively connected with the screw spindle for rotating the same in order to axially displace the abutment.

9. A machine as claimed in claim 8 wherein the drive motors comprise pulse motors, and further comprising a manually controlled pulse transmitter for controlling the operation of said motors.

10. A machine as claimed in claim 9 wherein the pulse transmitter is adapted to provide coordinated control of the motor for the adjustment of the applicator roll and the motor for the adjustment of the pick-up roll.

11. A machine as claimed in claim 5 further comprising a distribution roll co-operating with said pick-up roll, and a third bracket supporting said distribution roll said third bracket being mounted to said second bracket to be displaceable transversely of the distribution roll and the other rolls.

12. A machine as claimed in claim 11 further comprising means for displacing said brackets.

13. A machine as claimed in claim 11 further comprising an adjustable abutment member on each bracket, a stationary abutment on the frame of the machine for co-operation with the abutment member of said first bracket, an abutment on said first bracket for co-operation with the abutment member on said second bracket, and an abutment on said second bracket for co-operation with the abutment member on said third bracket.

14. A machine as claimed in claim 13 wherein each of the adjustable abutment members comprises a screw spindle, an abutment on said screw spindle, and a drive motor operatively connected with the screw spindle for rotating the same in order to axially displace the abutment.

15. A machine as claimed in claim 14 wherein the drive motors comprise pulse motors, and further comprising a manually controlled pulse transmitter for controlling the operation of said motors.

16. A machine for painting sheet-strip material comprising (a) a frame for the machine, (b) a backing roll for the sheet-strip material, (c) two paint-coating devices, each comprising a paint tub and rolls for coating the sheet-strip material, running over the backing roll, with paint from the paint tub, (d) means pivotally mounting said paint-coating devices for positioning each alternatingly in an operative position in which it co-operates with the backing roll and a non-operative position in which it is displaced from the path of the sheet strip material and (e) substantially vertical toothed segments on each paint-coating device and the frame of the machine, respectively, which are arranged to guidingly interengage when each paint-coating device is pressed against said frame of the machine.

* * * * *